US011140970B2

(12) United States Patent
Yeo

(10) Patent No.: US 11,140,970 B2
(45) Date of Patent: Oct. 12, 2021

(54) PORTABLE DEVICE HOLDER

(71) Applicant: Changki Yeo, Incheon (KR)

(72) Inventor: Changki Yeo, Incheon (KR)

( * ) Notice: Subject to any disclaimer, the term of this patent is extended or adjusted under 35 U.S.C. 154(b) by 0 days.

(21) Appl. No.: 16/803,573

(22) Filed: Feb. 27, 2020

(65) Prior Publication Data

US 2021/0204681 A1 Jul. 8, 2021

(30) Foreign Application Priority Data

Jan. 7, 2020 (KR) ..... 10-2020-0002094

(51) Int. Cl.
*A45F 5/00* (2006.01)

(52) U.S. Cl.
CPC ..... *A45F 5/00* (2013.01); *A45F 2200/0516* (2013.01)

(58) Field of Classification Search
CPC ..... A45F 5/00; A45F 2200/0516
USPC ..... 224/217
See application file for complete search history.

(56) References Cited

U.S. PATENT DOCUMENTS 4,763,763 A * 8/1988 Sadow ..... A45C 13/26 150/108
8,374,657 B2 * 2/2013 Interdonato ..... H04B 1/385 455/575.4
8,939,483 B2 * 1/2015 Kim ..... H04B 1/3888 294/25
8,950,638 B2 * 2/2015 Wangercyn, Jr. ..... A45F 5/00 224/217
D738,872 S * 9/2015 Erickson-Davis ..... D14/250
9,362,968 B1 * 6/2016 Haymond ..... H04B 1/385
9,762,278 B2 * 9/2017 Griffin, II ..... G06F 1/1626
9,793,941 B1 * 10/2017 Hirsch ..... H04B 1/385
10,063,272 B1 * 8/2018 Yeo ..... H04B 1/3888
10,349,728 B2 * 7/2019 Yoo ..... H04M 1/04
10,355,734 B1 * 7/2019 Otmani ..... H04B 1/3888
10,568,410 B2 * 2/2020 Pierson ..... H04M 1/04
10,610,004 B1 * 4/2020 Yeo ..... A45F 5/10
10,694,837 B1 * 6/2020 Altschul ..... H04B 1/3888
D894,167 S * 8/2020 Feller ..... D14/251
D894,889 S * 9/2020 Feller ..... D14/251
2004/0121798 A1 * 6/2004 Hamasaki ..... G06F 1/163 455/550.1
2006/0201594 A1 * 9/2006 Carmichael ..... A45C 1/04 150/143
2009/0270050 A1 * 10/2009 Brown ..... H04B 1/3833 455/90.3
2010/0222118 A1 * 9/2010 Interdanato ..... A45F 5/00 455/575.6
2011/0309117 A1 * 12/2011 Roberts ..... H04M 1/04 224/217

(Continued)

*Primary Examiner* — Peter N Helvey

(57) ABSTRACT

Disclosed is a configuration of a portable device holder. The portable device holder according to the present invention includes: a strap, a fixing plate, a closing plate, a movable plate and an attachment means. The portable device holder is attached to the back side of the portable device so that the portable device can be more stably hold or installed, can display promotional words and phrases on the central part of the strap where the central part is protruded if pushing both side tip ends and thus, can be used for sales promotion, and further, can reduce the occupied volume by spreading the strap when not in use.

6 Claims, 9 Drawing Sheets

(56) References Cited

U.S. PATENT DOCUMENTS

2012/0048873 A1* 3/2012 Hyseni ..... A45F 5/00
220/752
2017/0328514 A1* 11/2017 Cavalcante ..... A45C 11/00

* cited by examiner

【FIG. 1】
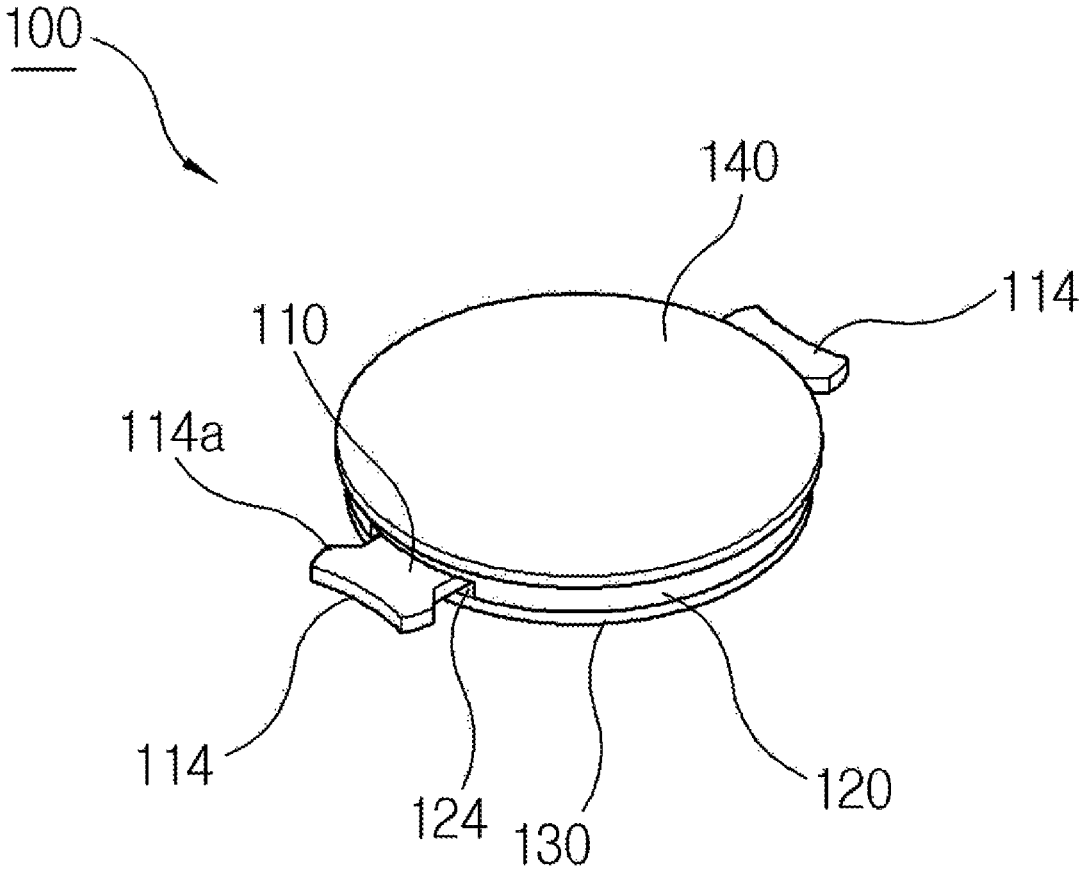

【FIG. 2】
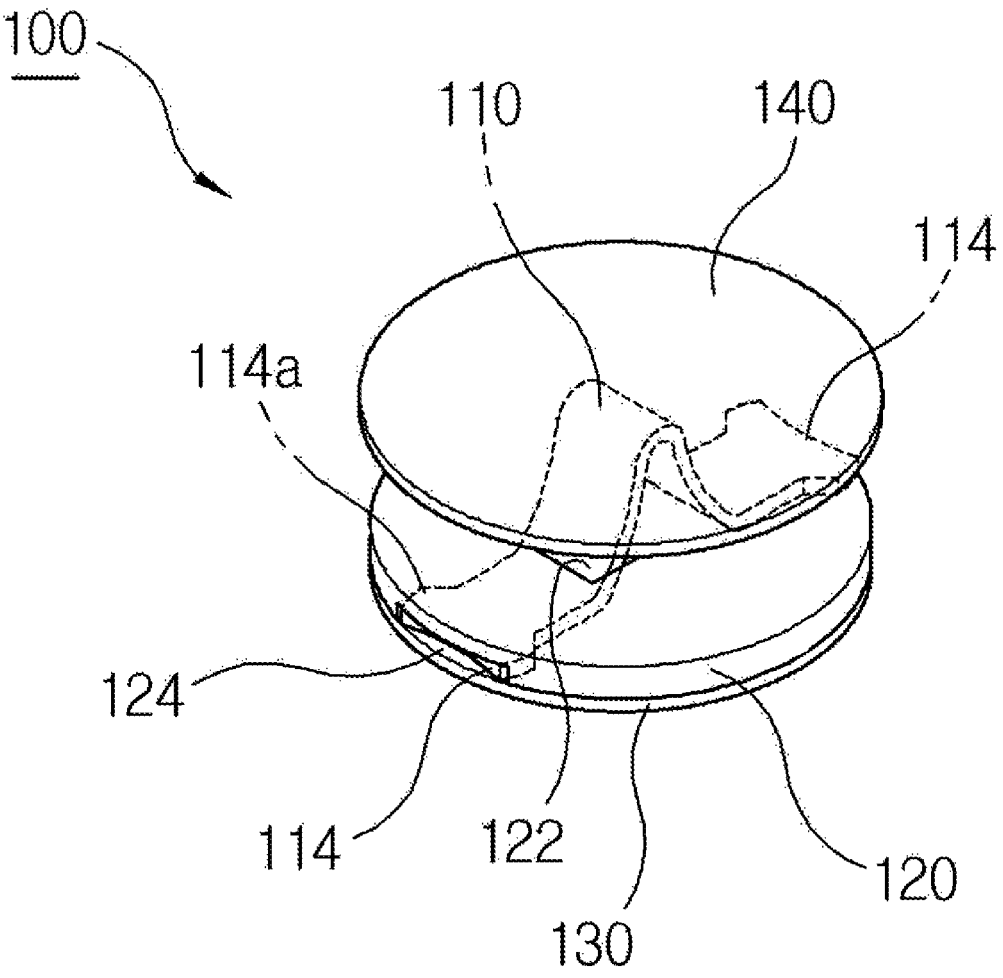

【FIG. 3】
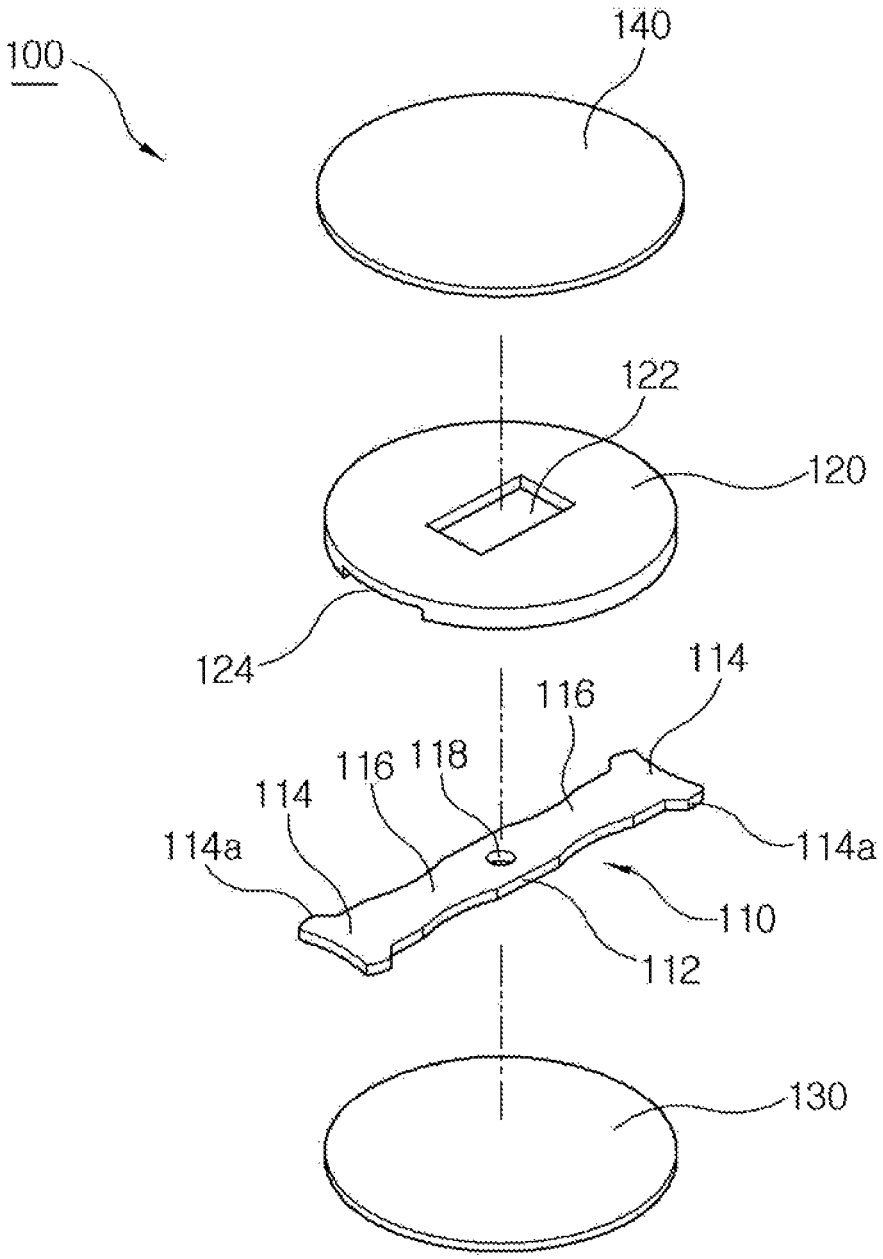

【FIG. 4】
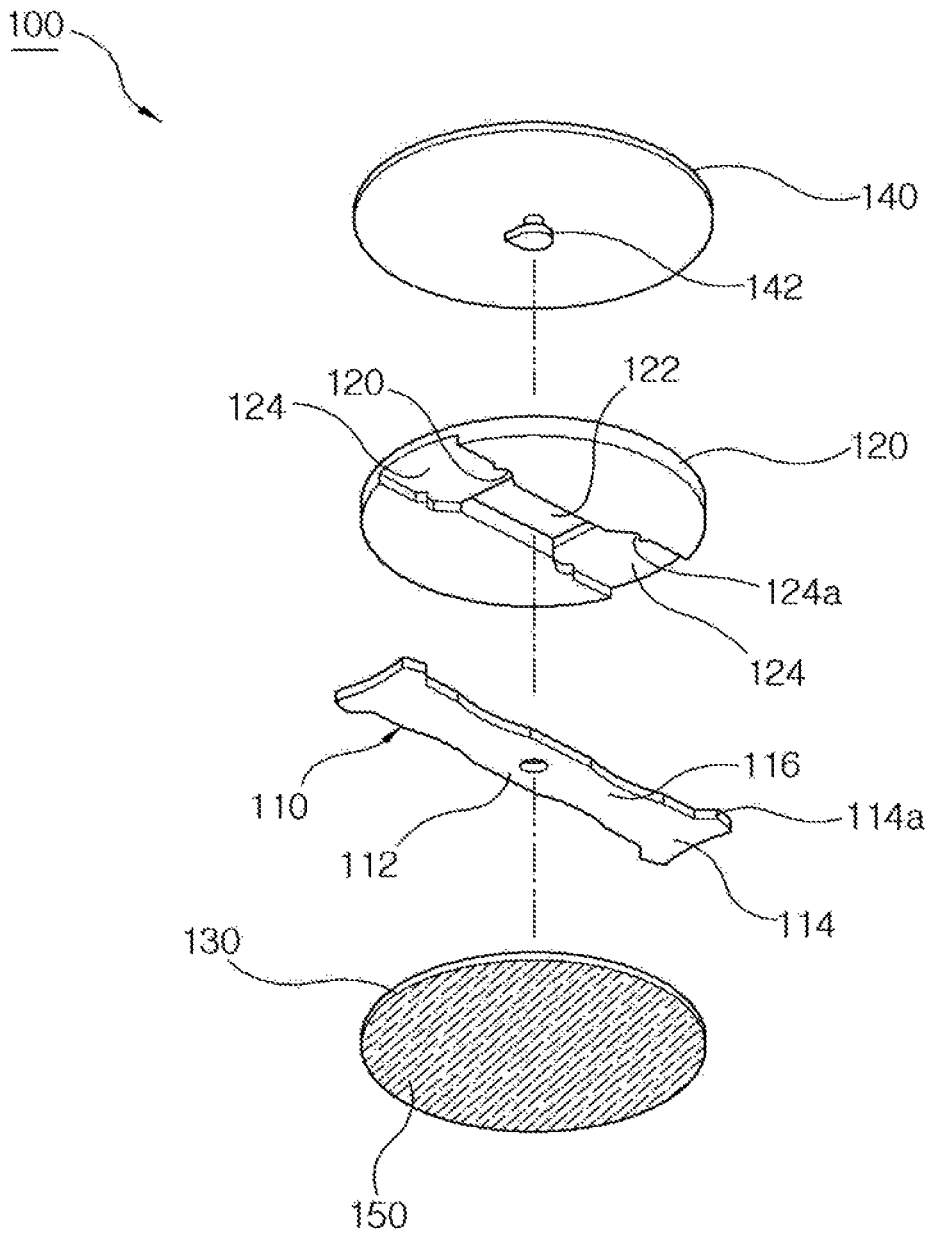

【FIG. 5】
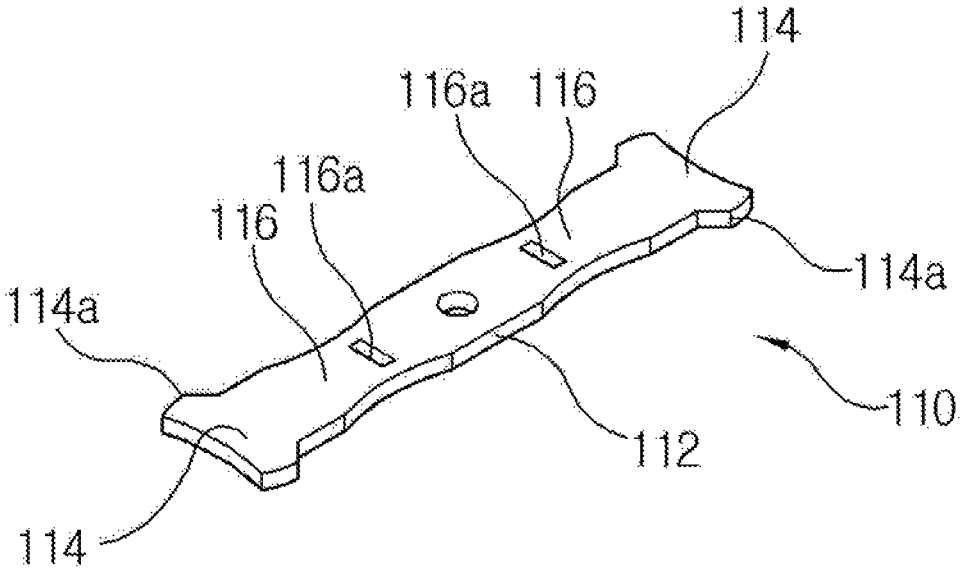

【FIG. 6】
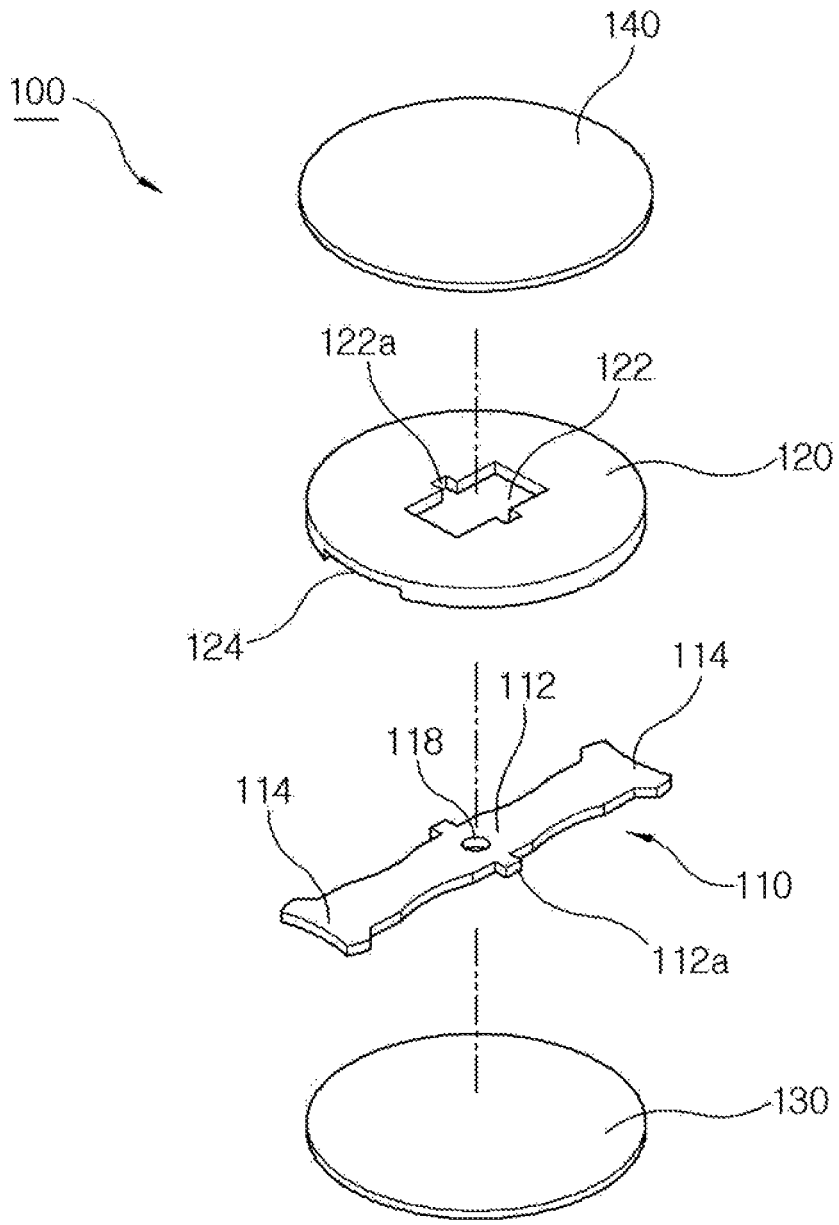

【FIG. 7】
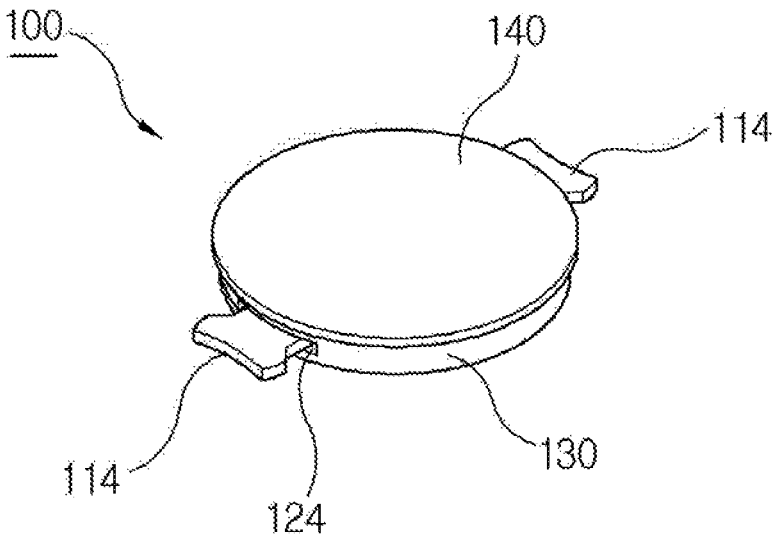
【FIG. 8】
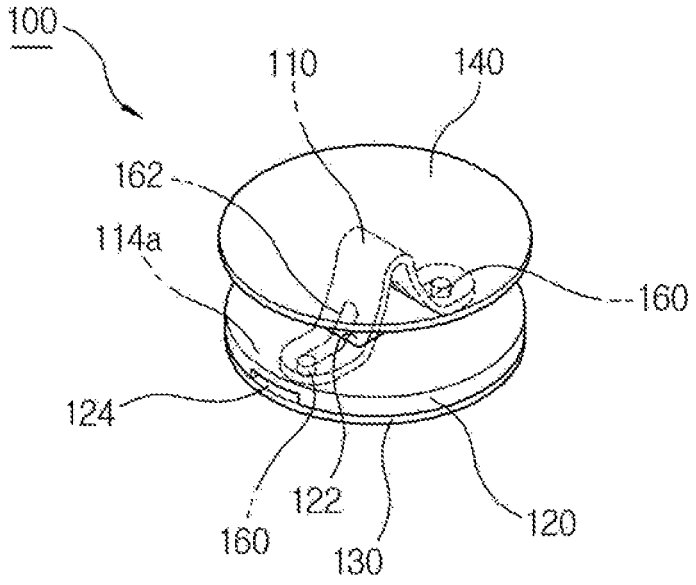

【FIG. 9】
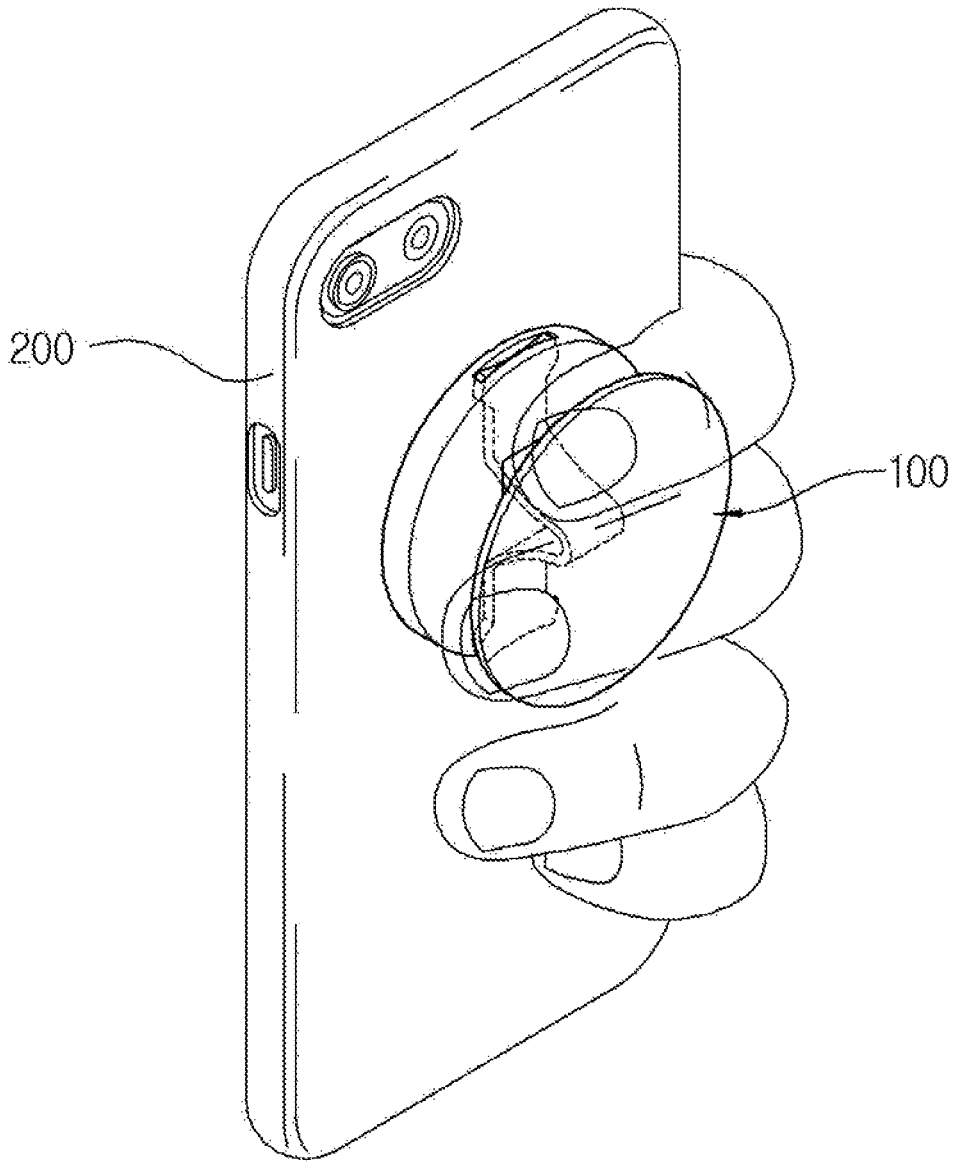

【FIG. 10】
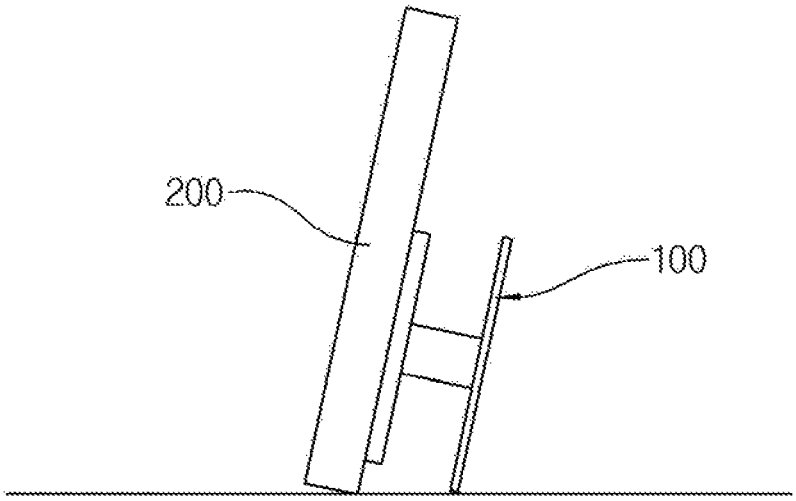
【FIG. 11】
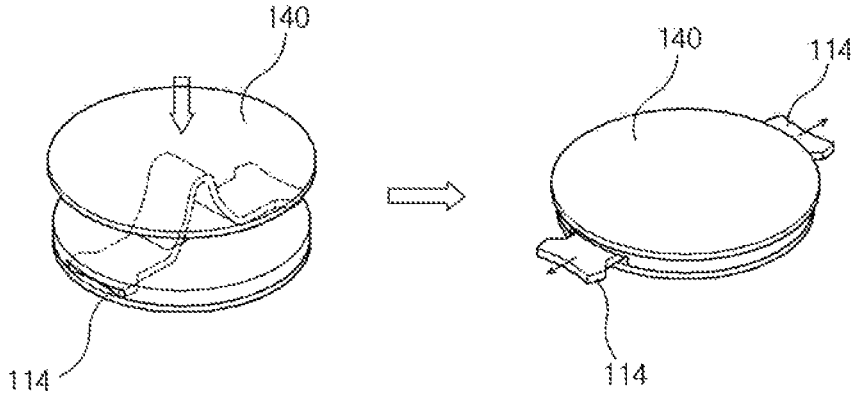

PORTABLE DEVICE HOLDER

CROSS-REFERENCE TO RELATED APPLICATION(S

This application claims priority to and benefit of Korean Patent Application No. 10-2020-0002094 filed on Jan. 7, 2020, the disclosure of which is hereby incorporated by reference in its entirety.

BACKGROUND OF THE INVENTION

(a) Field of the Invention

The present invention relates to a portable device holder, and more particularly, to a portable device holder that is attached to the back side of the portable device, so that the portable device can be more stably held or installed

(b) Description of the Related Art

As the spread of portable devices including smartphones has been expanded, various types of portable device accessories, which are configured so that they are attached to a portable device to hold it more stably, or to attach or install it to other objects, are being actively supplied.

Representative examples of such portable device accessory products may be a portable device case for protecting the liquid crystal and body of the portable device, a portable device holder for attaching to a portable device so as to hold the portable device stably, a portable device holder stand that allows a portable device to be attached to a car or the like, and the like. In addition, in the above examples, many products capable of achieving a portable device case function, a portable device holder function or a portable device stand function in combination have emerged.

The present applicant has also made many efforts for several years to provide consumers with better portable device accessory products. As part of such efforts, portable device accessory products disclosed in Korean Patent Registration No. 10-1939354, Korean Patent Registration No. 10-1979629, Korean Patent No. 10-1629434 and Korean Patent Registration No. 10-2019-0106512 have been developed.

On the other hand, in addition to the products developed by the applicant and supplied on the market, there are a great variety of portable device accessory products that can hold or install a portable device. However, due to the characteristics of the portable device accessory market that the period during which new portable devices are released has been gradually shortened and that the portable device accessories need to satisfy the diverse needs of consumers who are very sensitive to fashion, there is a constant need to develop portable device accessory products that can provide more various functions with newer structures.

PRIOR ART DOCUMENT

Patent Document (Patent Document 0001) Korean Unexamined Utility Model Publication 20-2012-0005267

(Patent Document 0002) Korean Utility Model Registration No. 20-0472008

(Patent Document 0003) Korean Patent Registration No. 10-1705819

(Patent Document 0004) Korean Patent Registration No. 10-1939354

(Patent Document 0005) Korean Patent Registration No. 10-1979629

(Patent Document 0006) Korean Unexamined Patent Publication NO. 10-2019-0106512

SUMMARY OF THE INVENTION

The present invention has been made in view of the above-described circumstances, and it is an object of the present invention to provide a portable device holder that is attached to the back side of the portable device so that the portable device can be more stably held or installed, can display promotional words and phrases on the central part of the strap where the central part is protruded if pushing both side tip ends and thus, can be used for sales promotion, and further, can reduce the occupied volume by spreading the strap when not in use.

The portable device holder according to one embodiment of the present invention includes: a strap which is formed in a band shape in which the length is longer than the width, both side tip parts are wider than a central part, the both sides are formed to be symmetrical with each other, and a hooking part having an outwardly protruding structure is respectively formed at the side surface of the both side tip parts; a fixing plate in which a rectangular pull-out part is formed through the central part so that the central part of the strap can be exposed to the outside, and a strap housing part having a shape corresponding to the tip part of the strap on both sides around the strap pull-out part is formed in a groove shape on the back side; a closing plate which is attached to the back side of the fixing plate to block the strap pull-out part and the strap housing part from being opened rearward; a movable plate which is installed on the central part of the strap, and operates to be spaced apart from the fixed plate at regular intervals while protruding the central part of the strap through the strap pull-out part of the fixing plate when the tip parts of the strap are operated in a direction close to each other; and an attachment means which is formed on one side surface of the closing plate so that the closing plate can be maintained in a state attached to the back side of the portable device.

In the portable device holder according to an embodiment of the present invention, the width of the central part of the strap is formed to be the same width in a certain section, and the operating part between the central part and the tip part may be formed to be a narrow width compared to the width of the central part and the tip part.

In the portable device holder according to an embodiment of the present invention, both side ends of the operating part of the strap may be formed in a concave shape, and the tip parts of the strap may be formed in a concave shape.

In the portable device holder according to an embodiment of the present invention, a bending guide may be respectively formed in a section of the strap corresponding to the boundary of the strap pull-out part of the fixing plate.

In the portable device holder according to one embodiment of the present invention, a center projection for guiding the center of the strap with respect to the fixing plate may be formed on the central part of the trap, while a center groove may be formed in the fixing plate at a position corresponding to the center projection.

In the portable device holder according to one embodiment of the present invention, the movable plate may be configured by a structure rotatably coupled to the central part of the strap.

The portable device holder according to an embodiment of the present invention can be placed in a folding state when not in use, thereby reducing the overall volume, and at the same time, allows the user to more stably hold and install a portable device by bending the strap during use and changing the position of the movable plate relative to the fixed plate.

In addition, promotional words and phrases can be displayed on the movable plate and thus it is effective to be used as sales promotion items.

BRIEF DESCRIPTION OF THE DRAWINGS

FIG. 1 is a perspective view of a portable device holder according to one embodiment of the present invention.

FIG. 2 is a perspective view of the operation state of the portable device holder according to one embodiment of the present invention.

FIG. 3 is a diagram showing an exploded state of the portable device holder according to one embodiment of the present invention.

FIG. 4 is a bottom perspective view showing an exploded state of the portable device holder according to one embodiment of the present invention.

FIG. 5 is a view for explaining the strap structure of the portable device holder according to another embodiment of the present invention.

FIGS. 6 and 7 are views for explaining the strap structure of the portable device holder according to another embodiment of the present invention.

FIG. 8 is a view showing the structure of a portable device holder according to another embodiment of the present invention.

FIGS. 9 to 11 are views showing a use state of the portable device holder according to one embodiment of the present invention.

DETAILED DESCRIPTION OF THE EMBODIMENTS

Hereinafter, the configuration and use state of the portable device holder according to the present invention will be described in detail with reference to the accompanying figures.

FIG. 1 is a perspective view of a portable device holder according to one embodiment of the present invention, FIG. 2 is a perspective view of the operation state of the portable device holder according to one embodiment of the present invention, FIG. 3 is a diagram showing an exploded state of the portable device holder according to one embodiment of the present invention, and FIG. 4 is a bottom perspective view showing an exploded state of the portable device holder according to one embodiment of the present invention. In the figure, reference numeral 100 indicates a portable device holder according to one embodiment of the present invention.

Referring to FIGS. 1 to 4, a portable device holder 100 is configured to include: a strap 110 which is formed in a band shape in which the length is longer than the width, and which are operated so that the central part is protruded toward the front surface while being bent if the tip parts 114 located on both sides apply external force in a direction closer to each other; a fixing plate 120 in which the strap 110 is housed and when the user presses both side tip parts 114 of the strap 110 so as to be close to each other, a strap pull-out part 122 for guiding the central part 112 to be protruded while being bent toward the front surface is formed through the central part, while a strap housing part 124 is formed on both sides of the strap pull-out part 122; a closing plate 130 which is attached to the back side of the fixing plate 120 to block the strap pull-out part 122 and the strap housing part 124 from being opened rearward, so that when both side tip parts 114 of the strap 110 are pressed in a direction close to each other, the central part 112 of the strap 110 is induced to be bent forward; a movable plate 140 which is installed at the central part 112 of the strap 110 and operates to be spaced apart with respect to the fixing plate 120 while moving together when the central part of the strap 110 protrudes forward; and an attachment means 150 which is formed on one side surface of the closing plate 130 so that the closing plate 130 can be maintained in a state attached to the back side of the portable device.

The portable device holder 100 according to one embodiment of the present invention is formed in a band shape in which the length is longer than the width as shown in the figure, and the tip parts 114 of both sides are wider than the central part 120 and the both sides are formed to be symmetrical with each other. In addition, a hooking part having an outwardly protruding structure is respectively formed at the side surface of the both side tip parts. In particular, the width of the central part 112 of the strap 110 is formed to be in the same width in a certain section, and the operating portion 116 between the central part 112 and the tip part 114 is formed to have a narrow width compared to the width of the central part 112 and the tip part 114. It is preferable that the both side tip parts of the operating portion 116 of the strap 110 are formed in a concave shape as shown in the figure. Further, in the process in which the user allows the both side tip part 114 of the strap 110 to be gathered inward with a fingertip, it is preferable to form the tip part in a concave shape so that the fingertip of the user can be contacted more stably.

A hinge hole 118 for assembling with the movable plate 140 may be formed through the central part 112 of the strap 110.

FIG. 5 is a view for explaining the strap structure of the portable device holder according to another embodiment of the present invention.

As shown in FIG. 5, a bending guide 116*a* is formed between the central part 112 and the tip part 114 of the strap 110, that is, in the section corresponding to the boundary of the strap pull-out part 122 of the fixing plate 120. In the case where the bending guide 116*a* is formed in this way, if the user performs the operation of pinching close in a state touching the fingers with both side tip parts 114 of the strap 110, the strap 110 is further bent by the corresponding portion where the bending guide 116*a* is formed. On the other hand, in the process in which the user presses the movable plate 140 to properly spread the strap 110, the corresponding portion having the bending guide 116*a* is hooked by a strap pull-out part 122, and thus the position of the strap 110 for the fixing plate 120 can be more stably maintained.

FIG. 6 is a view for explaining the strap structure of the portable device holder according to another embodiment of the present invention.

As shown in FIG. 6, a center protrusion 112*a* may be respectively formed at both sides of the central part 112 of the strap 110. The center protrusion 112*a* of the strap 110 is formed so as to guide the central position of the strap 110 in relationship with the fixing plate 120, and a center groove 122*a* having a shape corresponding to the center protrusion 112*a* is formed at the position of the fixing plate 120 having a shape corresponding to the center protrusion 112*a*.

The fixing plate 120 and the closing plate 130 of the portable device holder 100 according to an embodiment of the present invention may be integrally formed by being coupled to each other in the assembled state of the strap 110. FIG. 7 shows the structure of the portable device holder 100 according to another embodiment of the present invention. As shown in FIG. 7, this is an example in which the fixing plate and the closing plate are formed of a single body without distinction.

The fixing plate 120 of the portable device holder 100 according to an embodiment of the present invention has a square strap pull-out part 122 formed therethrough, so that the central part 112 of the strap 110 can be exposed to the outside, and at both sides around the strap pull-out part 122, a strap housing part 124 corresponding to the tip part 114 of the strap 110 is formed in a groove shape on the back side.

On the other hand, a hooking groove 124*a* is formed at the position of the strap housing part 124 corresponding to a hooking projection 114*a* of the strap 110 described above. The hooking protrusion 114*a* and the hooking groove 124*a* are formed in such a relationship that the hooking projection 114*a* is fitted into or separated from the hooking groove 124*a* when the user applies a certain level of force to both side tip parts of the strap 110 or when the movable plate 140 is pressed with a certain level of force.

And, the closing plate 130 formed in a plate shape having a size corresponding to the fixing plate 120 is attached to the back side of the fixing plate 120, thereby forming a structure that blocks the strap pull-out part 122 and the strap housing part 124 from being opened rearward as shown in the figure.

In the figure for explaining the structure of the fixing plate 120 of the portable device holder 100 according to an embodiment of the present invention, the fixing plate 120 is shown in a circular shape, but it goes without saying that the fixing plate 120 may be formed in a rectangular structure.

On the other hand, in the portable device holder 100 according to an embodiment of the present invention, the movable plate 140 is installed on the central part 112 of the strap 110, and when the tip parts of the strap 110 are operated in a direction close to each other, the central part 112 of the strap 110 is operated to protrude through the strap pull-out part 122 of the fixing plate 120, and at the same time, is operated so as to be spaced apart from the fixing plate 120 by a predetermined distance.

In the center of the rear surface of the movable plate 140, a hinge 142 for coupling with the strap 110 is formed by a protruding structure.

Phrases such as promotion or advertisement may be displayed on the movable plate 140.

In addition, the movable plate 140 may be formed in a circular shape corresponding to the fixed plate 120 as shown in the figure. At this time, the diameter of the movable plate 140 may be formed slightly larger than the diameter of the fixed plate 120 or may be formed slightly smaller.

Further, the movable plate 140 may be assembled by a structure rotatable with respect to the central part 112 of the strap 110.

FIG. 8 is a view showing the structure of a portable device holder according to another embodiment of the present invention.

As shown in FIG. 8, a guide pin 160 is formed on the strap housing part 124 of the fixing plate 120, and a guide rail 162 having a predetermined length may be formed through the strap 110 corresponding to the position of the guide pin 160. In other words, when the user operates, the guide rail 162 formed on the strap 110 is guided by the fixed guide pin 160, and it is possible to derive the operations of bending or spreading the strap 110 in a more constant direction and a predetermined stroke.

FIGS. 9 and 10 are views showing a use state of the portable device holder according to an embodiment of the present invention.

As shown in the figure, the portable device holder 100 according to an embodiment of the present invention is attached to the back side of the portable device 200 via the attachment means 150. The attachment means 150 may be formed by applying an adhesive to a back side of the closing plate 130, or may be formed by a tape coated with the adhesive.

When the user presses in the direction in which both tip parts of the strap 110 are close to each other using a finger or the like, the central part of the strap 110 protrudes through the strap pull-out part 122, and the movable plate 140 is spaced apart from the fixed plate 120 by a predetermined distance as shown in the figure. At this time, the spaced interval is set in the range of 10 to 30 mm which is about the thickness of the user's finger.

Thereafter, when the user grips the portable device by positioning the strap 110 between the fixing plate 120 and the movable plate 140 and interposing his/her finger therebetween, it is possible to grab the portable device in a more stable state.

In addition, as shown in FIG. 10, the portable device 200 can be placed on a desk or the like.

FIG. 11 is a view showing a state in which the portable device holder 100 according to one embodiment of the present invention is returned to a state before use after fitting the use thereof.

As shown in FIG. 11, when the movable plate 140 is pressed after fitting the use, the strap 110 is spread while the tip parts of the strap 110 are moved outward, and thus, the movable plate 140 becomes in a state of being in close contact with the fixing plate 120. Therefore, when not in use, the volume is reduced, which is advantageous for storing the portable device in a pocket or the like.

In the above, the portable device holder 100 has been described by way of several embodiments. Such embodiments are included in the technical spirit described in the claims of the present invention. In addition, these embodiments are for illustrative purposes only, and should not be construed as limiting the scope of the claims of the present invention.

EXPLANATION OF SYMBOLS

100: portable device holder 110: strap
112: central part 114: tip part
114*a*: hooking protrusion 116: operating part
120: fixing plate 122: strap pull-out part
124: strap housing part 124*a*: hooking groove
130: closing plate 140: movable plate
142: hinge 150: attachment means
160: guide pin 162: guide rail
200: portable device

What is claimed is:

1. A portable device holder comprising:

a strap which is formed in a band shape in which the length is longer than the width, both side tip parts are wider than a central part, the both sides are formed to be symmetrical with each other, and a hooking part having an outwardly protruding structure is respectively formed at the side surface of the both side tip parts;

a fixing plate in which a rectangular pull-out part is formed through the central part so that the central part of the strap can be exposed to the outside, and a strap housing part having a shape corresponding to the tip part of the strap on both sides around the strap pull-out part is formed in a groove shape on the back side;

a closing plate which is attached to the back side of the fixing plate to block the strap pull-out part and the strap housing part from being opened rearward;

a movable plate which is installed on the central part of the strap, and operates to be spaced apart from the fixed plate at regular intervals while protruding the central part of the strap through the strap pull-out part of the fixing plate when the tip parts of the strap are operated in a direction close to each other; and an attachment means which is formed on one side surface of the closing plate so that the closing plate can be maintained in a state attached to the back side of the portable device.

2. The portable device holder of claim 1, wherein the width of the central part of the strap is formed to be the same width in a certain section, and the operating part between the central part and the tip part is formed with a narrow width compared to the width of the central part and the tip part.

3. The portable device holder of claim 2, wherein the both side ends of the operating part of the strap are formed in a concave shape, and the tip parts of the strap are formed in a concave shape.

4. The portable device holder of claim 1, wherein a bending guide is respectively formed in a section of the strap corresponding to the boundary of the strap pull-out part of the fixing plate.

5. The portable device holder of claim 1, wherein a center projection for guiding the center of the strap with respect to the fixing plate is formed on the central part of the trap, while a center groove is formed in the fixing plate at a position corresponding to the center projection.

6. The portable device holder of claim 1, wherein, the movable plate is configured by a structure rotatably coupled to the central part of the strap.

* * * * *